US009196106B2

(12) United States Patent
Pierce

(10) Patent No.: US 9,196,106 B2
(45) Date of Patent: Nov. 24, 2015

(54) AUTOMATIC COIN SORTING DEVICE

(71) Applicant: MerchSource, LLC, Irvine, CA (US)

(72) Inventor: Mike Pierce, Dana Point, CA (US)

(73) Assignee: MerchSource, LLC, Irvine, CA (US)

( * ) Notice: Subject to any disclaimer, the term of this patent is extended or adjusted under 35 U.S.C. 154(b) by 28 days.

(21) Appl. No.: 13/732,016

(22) Filed: Dec. 31, 2012

(65) Prior Publication Data

US 2013/0183892 A1 Jul. 18, 2013

Related U.S. Application Data

(60) Provisional application No. 61/581,998, filed on Dec. 30, 2011.

(51) Int. Cl.

| | |
|---|---|
| ***G07D 9/06*** | (2006.01) |
| ***G07D 3/02*** | (2006.01) |
| ***G07D 5/02*** | (2006.01) |
| ***G07D 5/00*** | (2006.01) |
| ***G07D 3/00*** | (2006.01) |
| ***G07D 3/04*** | (2006.01) |

(52) U.S. Cl.

CPC .. *G07D 3/02* (2013.01); *G07D 3/04* (2013.01); *G07D 5/02* (2013.01); *G07F 3/00* (2013.01); *G07F 3/02* (2013.01); *G07F 3/022* (2013.01); *G07F 3/04* (2013.01)

(58) Field of Classification Search

CPC ..... G07D 9/06; G07D 3/02; G07D 3/04; G07D 3/06; G07D 3/08; G07D 3/10; G07D 3/12; G07D 5/02; G07F 3/00; G07F 3/02; G07F 3/027; G07F 3/022; G07F 3/04; G07F 9/00; G07F 9/06

USPC ..... 453/61–63, 14; 232/12; 194/334, 338, 194/353

See application file for complete search history.

(56) References Cited

U.S. PATENT DOCUMENTS

| | | | | |
|---|---|---|---|---|
| 961,832 | A * | 6/1910 | Ayers | 53/254 |
| 1,280,031 | A * | 9/1918 | Hinds et al. | 53/254 |
| 4,374,529 | A * | 2/1983 | Kobayashi et al. | 453/17 |
| 4,374,557 | A * | 2/1983 | Sugimoto et al. | 194/215 |
| 4,495,959 | A * | 1/1985 | Farber | 453/9 |
| 4,593,709 | A | 6/1986 | Duplessy | |
| 4,911,280 | A | 3/1990 | Bruner | |
| 5,474,496 | A | 12/1995 | Perkitny | |
| D393,530 | S | 4/1998 | Perkitny | |

(Continued)

OTHER PUBLICATIONS

Money Miser; Magnif; http://www.magnif.com/shop/money-miser/; Admitted prior art; undated.

(Continued)

*Primary Examiner* — Jeffrey Shapiro
(74) *Attorney, Agent, or Firm* — Avyno Law P.C.

(57) ABSTRACT

An automatic coin sorting device is provided. The sorting device may include a housing having a hopper configured for receiving coins, a coin tray coupled to the housing, wherein the coin tray is moveable from a first position to a second position, and a plurality of tubular coin receiving members removably secured to the coin tray, wherein each tubular coin receiving member is configured for receiving a different-sized coin. Each tubular coin receiving member includes an angled opening near one face of the coin receiving member to prevent jamming or back-filling of the coins when the coin receiving member is filled to capacity.

14 Claims, 4 Drawing Sheets

(56) References Cited

U.S. PATENT DOCUMENTS

| | | | | |
|---|---|---|---|---|
| 5,902,178 | A | 5/1999 | Perkitny | |
| 5,944,600 | A * | 8/1999 | Zimmermann | 453/10 |
| 5,944,601 | A * | 8/1999 | Hayashi et al. | 453/61 |
| 6,086,473 | A * | 7/2000 | Hayashi et al. | 453/37 |
| 6,099,401 | A | 8/2000 | Perkitny | |
| 6,165,063 | A * | 12/2000 | Perkitny | 453/9 |
| 6,165,064 | A * | 12/2000 | Aurelius et al. | 453/18 |
| 6,346,039 | B2 * | 2/2002 | Orton et al. | 453/3 |
| 6,443,829 | B1 | 9/2002 | Perkitny | |
| 6,524,179 | B2 | 2/2003 | Perkitny et al. | |
| 6,540,601 | B2 | 4/2003 | Nottingham et al. | |
| 6,585,581 | B2 | 7/2003 | Nottingham et al. | |
| 6,638,157 | B2 | 10/2003 | Perkitny | |
| 6,830,509 | B2 | 12/2004 | Perkitny | |
| 6,966,827 | B2 | 11/2005 | Perkitny | |
| 7,048,623 | B2 | 5/2006 | Perkitny | |
| 7,204,749 | B2 | 4/2007 | Perkitny | |
| 2003/0100255 | A1 * | 5/2003 | Allison | 453/14 |
| 2003/0148729 | A1 * | 8/2003 | Abe et al. | 453/57 |
| 2004/0117061 | A1 * | 6/2004 | Angove et al. | 700/236 |
| 2006/0054455 | A1 * | 3/2006 | Kuykendall et al. | 194/217 |
| 2008/0014850 | A1 * | 1/2008 | Levasseur et al. | 453/18 |
| 2011/0076930 | A1 * | 3/2011 | Chang | 453/18 |

OTHER PUBLICATIONS

Digital Coin Sorter; Magnif; http://www.magnif.com/shop/digital-coin-sorter/; Admitted prior art; undated.

AccuWrapper Motorized Coin Sorter; Magnif; http://www.magnif.com/shop/accuwrapper-motorized-coin-sorter/; Admitted prior art; undated.

Money Wrapper Bank; Magnif; http://www.magnif.com/shop/money-wrapper-bank/; Admitted prior art; undated.

Magnif Coin Shark Motorized Coin Sorter; http://store.homecoincounters.com/homecoin4895.html; Admitted prior art; undated.

* cited by examiner

AUTOMATIC COIN SORTING DEVICE

RELATED APPLICATIONS

This application claims priority of U.S. Provisional Application Ser. No. 61/581,998, filed on Dec. 30, 2011, titled AUTOMATIC COIN SORTING DEVICE, which application is incorporated in its entirety by reference in this application.

BACKGROUND OF THE INVENTION

1. Field of the Invention

The present invention relates generally to a coin sorting device, and in particular, an automatic coin sorting device.

2. Related Art

A favorite pastime for many children and adults is the collection of coins. Coins collectors often store these coins in ornamental receptacles such as piggy banks, coin jars, coffee mugs, and even used water jugs. However, when these receptacles become full, the coin collector must package the coins for depositing with a bank.

Banks only deposit coins packaged in coin sleeves, also known as roll wrappers, thus the coins must be sorted by the coin collector in various quantities (e.g., a roll of 50 pennies equal to $0.50, or a roll of 40 nickels equal to $2) before they can be deposited. Years ago, coin sorters would actually have to count and sort the various quantities by hand and wrap them in the roll wrappers. Counting and sorting coins manually is time consuming.

Over the course of time, coin machines were developed to assist banks in counting and verifying coin deposits. These coin machines automatically sorted coins according to their value (i.e., pennies, nickels, dimes, quarters, etc.). Thus, some banks began to allow coin collectors to deposit coins without sorting them prior to deposit as a convenience to their customers.

However, coins, especially old coins, tend to accumulate debris that stick to the coins. This debris is typically dislodged from the coins when coins are processed in a coin machine, thus debris tends to build-up and clog the various moving parts of the coin machine. This makes operating coin machines very expensive because maintenance is frequently needed. Because of the expense of operating coin machines, banks have begun to outsource their processing of large quantities of coins. Thus, coin collectors are, once again, required to roll their own coins before depositing them with the bank.

Personal coin banks or coin sorters are generally known and commonly used. In most personal coin sorters, a user places one or more coins into a hopper or similar receiving location that delivers the coins to a coin separating mechanism. The coin separating mechanism then separates the coins and moves them into a coin sorting assembly. The coin sorting assembly classifies the coins by their diameter and coins of a particular diameter, consequently a particular denomination, are directed into the appropriate one of a plurality of sorted coin storage containers.

However, personal coin sorters have a tendency to jam or back-fill when the coin storage containers are filled to capacity. Thus, a need therefore exists for a compact coin sorting device that is simple use, has few moving part, does not jam or back-fill, and provides a quick and easy means for packaging coins.

SUMMARY

An automatic coin sorting device is provided that prevents coins from jamming in the device. In one implementation of the invention, the sorting device may include a housing having a hopper configured for receiving coins, a coin tray coupled to the housing, wherein the coin tray is moveable from a first position to a second position, and a plurality of tubular coin receiving members removably secured to the coin tray, wherein each tubular coin receiving member is configured for receiving a different-sized coin. Each tubular coin receiving member includes an angled opening near one face of the coin receiving member.

In another implementation of the invention, the automatic coin sorting device may include a housing having a front panel, a back panel secured to the front panel, a top portion including a hopper configured for receiving coins, and a bottom portion including a compartment configured for receiving a coin tray hingedly affixed to a side wall of the compartment, wherein the coin tray is alterable between a closed position and an open position. In the closed position, the coin tray is positioned within the compartment and, in the open position, the coin tray is positioned at an angle θ relative to the front panel, wherein θ ranges from approximately 0° to 90°. The coin sorting device includes a plurality of tubular coin receiving members removably secured to the coin tray, wherein each tubular coin receiving member is configured for receiving a different-sized coin. In this way, each tubular coin receiving member includes an angled opening near one face of the coin receiving member. The device further includes a coin separating wheel in communication with the hopper and configured for separating different-sized coins, wherein the coin separating wheel is positioned between the front panel and the back panel; and a ramp in communication with the coin separating wheel, wherein the ramp is configured for receiving the separated coins from the coin separating wheel and providing a pathway for the coins to be distributed to the coin receiving members via apertures in communication with the coin receiving member. Each aperture in the ramp is sized to distribute a different-sized coin.

According to another aspect of the invention, a tubular coin receiving member is provided that is configured for receiving a predetermined sized coin. The coin receiving member includes a top opening, whereby the top opening includes an angled opening near one face of the coin receiving member. The angled opening enables excess coins to fall from the top of the receiving member when the receiving member accumulates a predetermined number of coins. For example, the coin receiving member may be configured to only hold 50 pennies, 40 nickels, 50 dimes, or 40 quarters.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

FIGS. 1-6 illustrate various implementations of a coin sorting device of the present invention. The coin sorting device may be utilized to sort coins of various sizes and denominations, such as quarters, nickels, dimes and pennies, for example.

Figure 1:
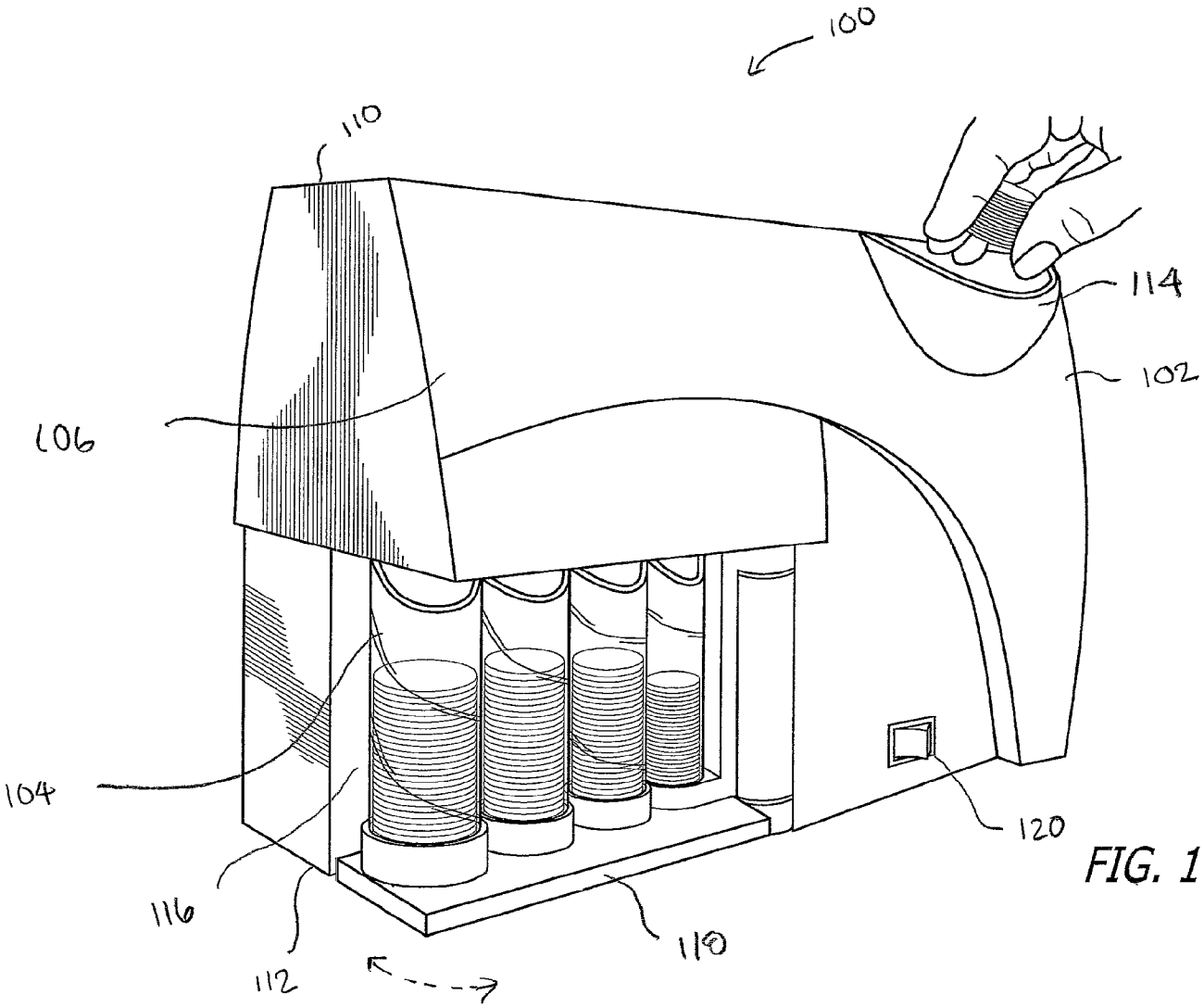
FIG. 1 is a perspective side view of an implementation of a coin sorting device according to the present invention.

In particular, FIG. 1 is a perspective side view of an implementation of a coin sorting device 100 according to the present invention. As illustrated, the coin sorting device 100, may generally include housing 102, a plurality of tubular coin receiving members 104 (one for each denomination of coins meant to be sorted), a coin separator 502 (see FIG. 5), and a sorting ramp 504 (see FIG. 5) in communication with the coin separator 502 and the tubular coin receiving members 104. The housing 104 may include a front panel 106, a back panel (not shown) secured to the front panel 106, a top portion 110, and a bottom portion 112. The housing 104 may be made of a durable plastic, metal, or other suitable material.

The top portion 110 may include a hopper 114 configured for receiving coins. In some implementations, the top portion 110 may include a coin counter for computing, and a digital display for displaying the dollar value of each denomination and the total value of all coins sorted and counted. The bottom portion 112 may include a compartment 116 for receiving a coin tray 118 hingedly affixed to a side wall of the compartment 116. The coin tray 118 may be made of the same or other material complementary to that of the housing 104.

The coin tray 118 may be alterable (e.g., rotatable) between a closed position and an open position. In the closed position, the coin tray 118 may be positioned substantially (or in some implementations, completely) within the compartment 116. In the open position, the coin tray 118 may be positioned at an angle θ relative to the front panel, wherein θ may range from about 0° to about 90°. In other implementations, the coin tray 118 may not be rotatable but, instead, configured to slide in-and-out of the compartment 116.

The tubular coin receiving members 104 may be removably secured to the coin tray 118. Each coin receiving member 104 may be made of plastic or other suitable material and configured for receiving different-sized coin (i.e., coins of different denominations).

The coin separator 502 may be in communication with the hopper 114 and may be configured for separating different-sized coins in the event different-sized coins are placed in the hopper 114. The coin separator 502 may be positioned between, and substantially perpendicular to, the front panel 106 and the back panel of the housing 102.

The sorting ramp 504 may be configured for receiving the separated coins from the coin separator 502 and providing a pathway for the coins to be distributed to the coin receiving members 104 via apertures in the ramp. Each aperture in the ramp may be in communication with a corresponding coin receiving member 104 and dimensioned to distribute a different-sized coin. In this way, each aperture may be aligned with a corresponding coin receiving member to receive coins of the appropriate size for the particular coin receiving member 104.

The coin sorting device 100 may include an on/off switch 120 in communication with appropriate electronic circuitry for powering the coin separator 502 when a user actuates the switch to the "on" position. The coin sorting device 100 may further include a battery compartment (not sown) and/or an A/C port (both not shown) for powering the coin separator 502.

Figure 2:
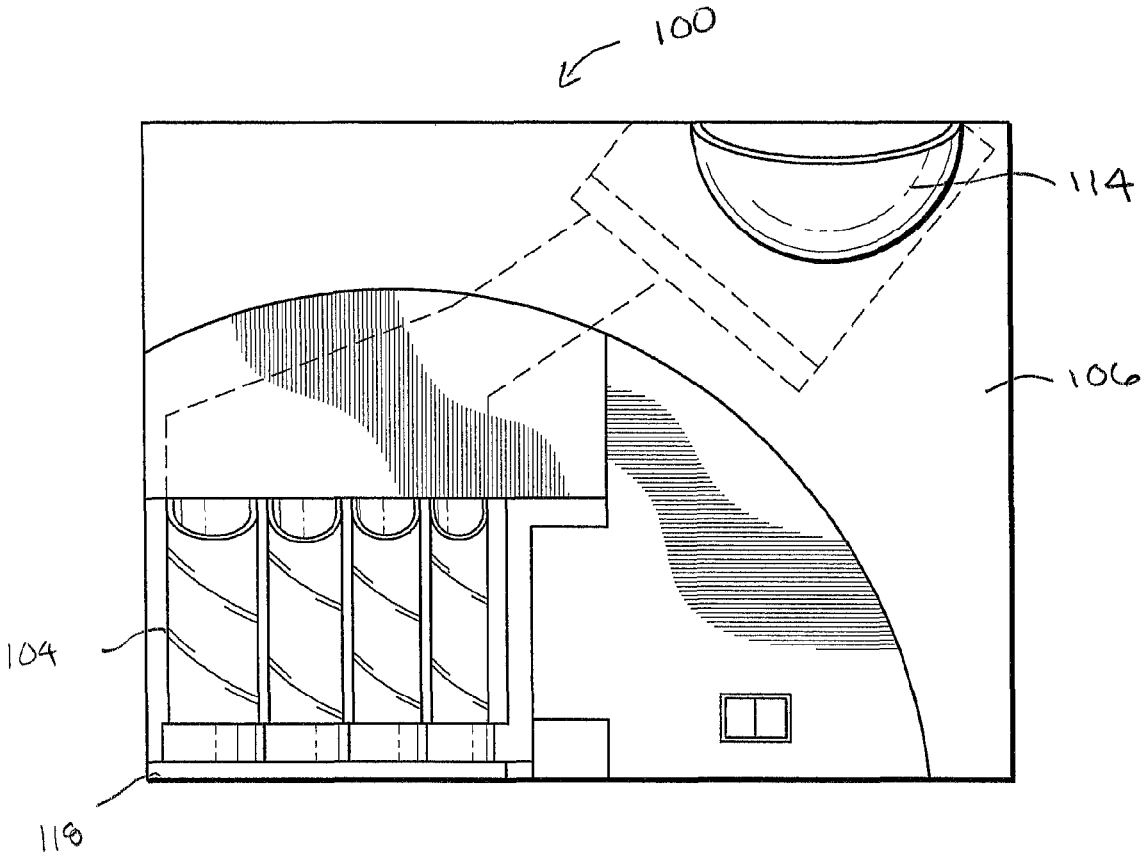
FIG. 2 is a side elevation view of the coin sorting device illustrated in FIG. 1, showing the front panel.

FIG. 2 is a side elevation view of the coin sorting device 100, showing the front panel 106. The positions of the coin separator and the sorting ramp within the housing are shown with broken lines. FIG. 2 further shows the position of the coin tray 118 carrying the coin receiving members 104, relative to the sorting ramp.

Figure 3:
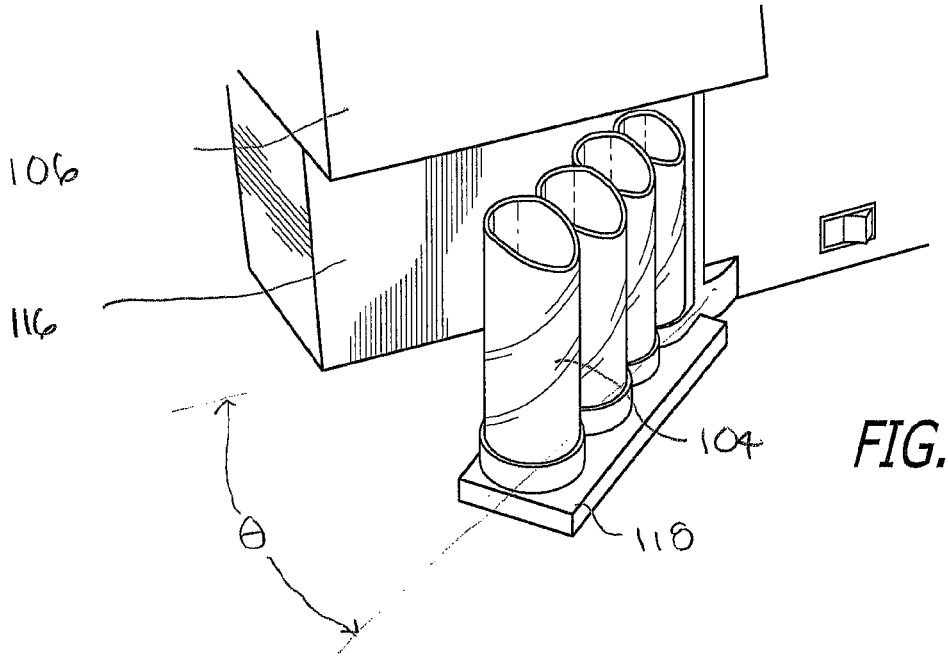
FIG. 3 is a partial side perspective view of the coin sorting device illustrated in FIG. 1, showing the coin tray in the open position.

FIG. 3 is a partial side perspective view of the coin sorting device 100, showing the coin tray 118 in the open position. As shown, the coin tray 118 may be opened (i.e., rotated) to an angle θ relative to the front panel 106. In some implementations, the coin tray 118 may be slidably removable from the compartment 116 in lieu of, or in addition to, being hingedly affixed to a side wall of the compartment 116.

Figure 4:
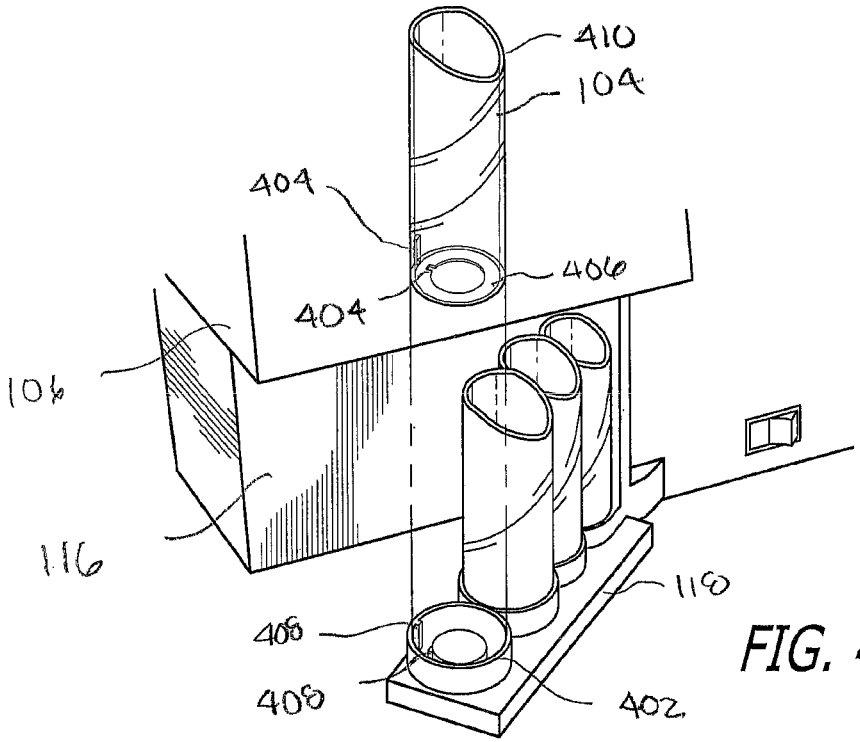
FIG. 4 is a partial side perspective view of the coin sorting device illustrated in FIG. 1, showing the coin tray in the open position, and further showing one of the tubular coin receiving members removed from the coin tray.

FIG. 4 is a partial side perspective view of the coin sorting 100, showing the coin tray in the open position and, further, showing one of the tubular coin receiving members 104 removed from the coin tray 118. As shown in FIG. 4, the coin tray 118 may include ports 402 dimensioned to removably secure complementarily-sized receiving members 104 to the coin tray. As shown, each receiving member 104 may include one more slots 404 formed in or near a closed end 406 of the receiving member 104. The slots 404 may correspond to one or more keys 408 formed in the base of the ports 402 for positioning and retaining the receiving members 104 in a certain orientation on the coin tray 118. In other implementations, the receiving members 104 may be pressed-fit into the ports 402 or integrally formed with the coin tray 118.

To avoid the coins from jamming or back-filling into housing 102, the tubular coin receiving members 104 are designed to have an angled opening 410 traversing a portion of the top of the tubular coin receiving member 104, opposite the closed end 406. The angled opening 410 is positioned to face forward, towards the user, and permits coins to fall from the tubular coin receiving members 104 when the coin trays 118 become full. As clearly shown in FIGS. 3 and 4, the angled opening 410 may only traverse a portion of the top of the tubular coin receiving member 104, while the remaining portion of the top of the tubular coin receiving member 104 may be substantially horizontal (i.e., parallel to the closed end 406). In some implementations, the angled opening 410 may be dimensioned height-wise such that when a receiving member 104 becomes full, it may not be filled above its typical roll quantity (e.g., 50 pennies, 40 nickels, 50 dimes, 40 quarters, etc.).

Figure 5:
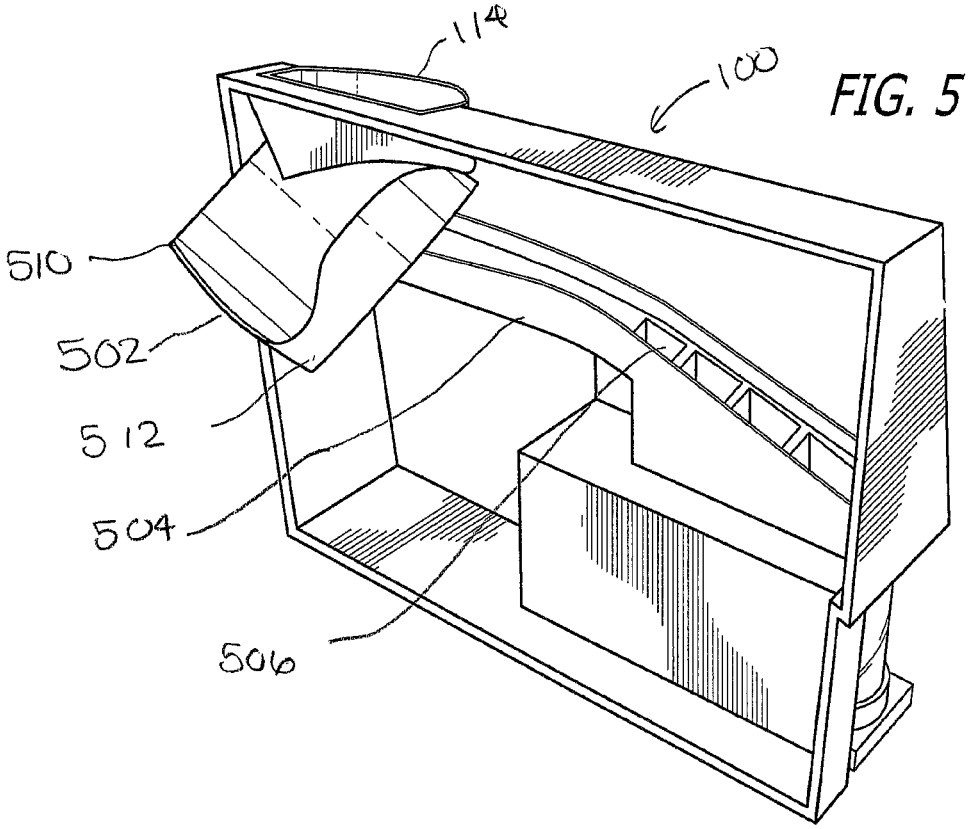
FIG. 5 is a perspective side view of the interior of the coin sorting device illustrated in FIG. 1, without the back panel.

FIG. 5 is a perspective side view of the interior of the coin sorting device 100, without the back panel. FIG. 5 illustrates the ramp 504 in communication with the coin separator 502 and its relative position to the compartment 116. In addition, FIG. 5 illustrates apertures 506 in the sorting ramp 504, corresponding to the various coin dimensions.

In some implementations, as the distance from the coin separator increases, the dimensions of each aperture 506 increases. In this way, the largest-sized coin to be sorted will travel further down the ramp and will pass over the smaller apertures as the largest-sized coin travels down the ramp to the largest-sized aperture.

Also shown, the coin separator 502 may include a semi-annular guide wall 510 that terminates into a basin 512. The basin 512 is designed to hold the coins of mixed denominations placed in the hopper 114 until they are deposited onto and separated by a separating wheel.

Figure 6:
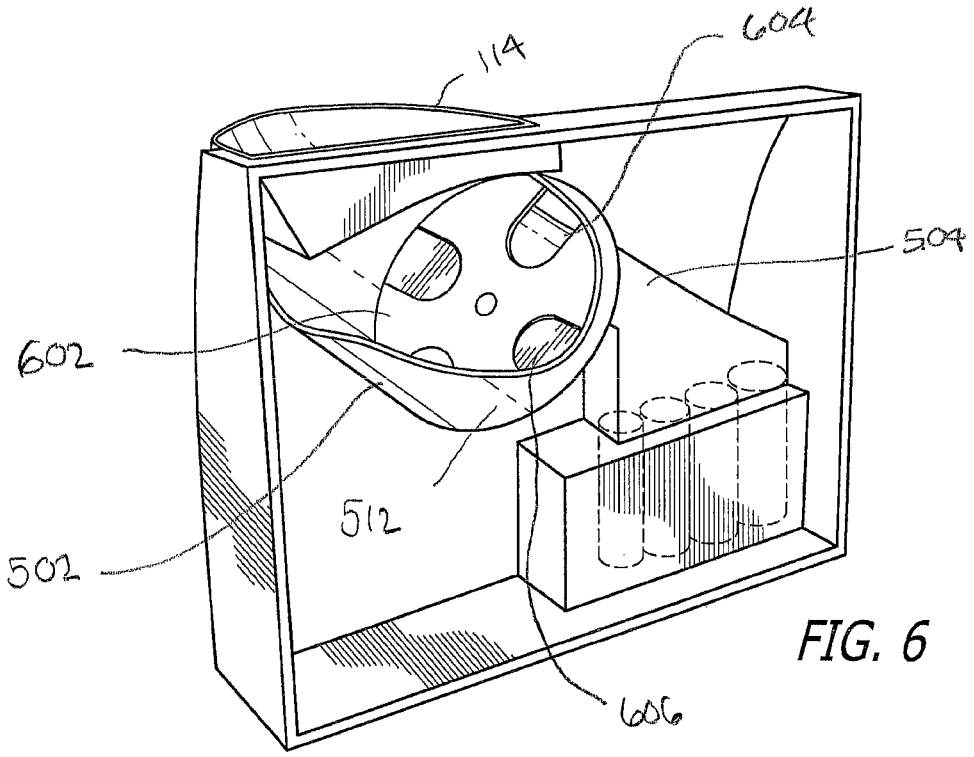
FIG. 6 is another perspective side view of the interior of the coin sorting device illustrated in FIG. 1, without the back panel.

FIG. 6 is another perspective side view of the interior of the coin sorting device 100, without the back panel. FIG. 6 illustrates the coin separator in more detail. As shown in FIG. 6, the coin separator 502 may include a coin separating wheel 602 having a plurality of U-shaped notches 604 formed in its periphery. The coin separating wheel 602 may be made of durable plastic, metal or other suitable non-corrosive material.

Each notch 604 is sized to be larger in width than the largest coin which is to be sorted by the coin sorter. However, thickness of the separating wheel 602 may be chosen to be less than or equal to the thickness of the thinnest coin to be sorted so that only one coin at a time is engaged by each notch 604. In some implementations, each notch 604 may be dimensioned to receive a different-sized coin.

The coin separating wheel 602 is mounted on a planar base surface 606 of the basin 512. In some implementations, the basin 512 may be being fixed to the top portion 110 of the housing 102 at a slope, for example of 45°, from the horizontal. As such, coins tend to come to rest in the lowermost portion of the basin 512 with their faces contacting the separating wheel 602.

The coin separating wheel 602 may rotate in either a clockwise or counterclockwise direction by a motor (not shown) or other suitable power means when the on/off switch 120 of the coin sorting device 100 is actuated to the "on" position. When the separating wheel 602 is rotated, it will engage a coin with the edge of one of its notches 604 and carry it upward along the base 606 until the coin eventually passes into communication with the sorting ramp 504. As the notch 604 containing the coin passes into communication with the sorting ramp 504, the coin may drop onto the ramp 504 and may travel down the ramp in the direction of the apertures 506 in the ramp. The coin may continue to travel down the ramp 504 until the coin falls into the appropriate aperture 506 and into the corresponding tubular receiving member 104. In this way, a plurality of coins may be sorted until one or more of the tubular coin receiving members 104 is filled with the desired number of coins, for example.

In some implementations, the receiving members 104 may be configured such that roll wrappers may be installed into the receiving members 104 so the coins can be easily packaged. In other implementations, the receiving members 104 may be configured such that coins may easily slide from the members into the roll wrapper for packaging.

In sum, the operation of the coin sorting device 100 according to the present invention is as follows. A user may place a plurality of coins varied in size into the hopper 114 of the coin sorting device. As coins are dropped into the hopper 114, they will slide down the guide wall 510 into the basin 512 and onto the separating wheel 602. As the wheel 602 is rotated, it engages a coin with its notches 604 and carries it upward until the coin eventually passes into communication with the sorting ramp 504. As the notch 604 passes into communication with the sorting ramp 504, the coin drops onto and slides down the ramp 504, where the separated coins are distributed via the apertures 506 in the ramp 504 to the appropriate tubular coin receiving members 104. Coins may be deposited into their respective receiving members 104 until the receiving members have accumulated a maximum number of coins. Once the receiving members 104 have reached their capacity, the angled opening 410 of the receiving members 104 prevents the device from jamming or back-filling by enabling excess coins to fall from the top of the receiving members 104 until the device is shut off.

After the coin sorting process is done, and when it is desired to remove the coins which have been stored, the coin tray 118 may be rotated forwardly from its closed position and into its open position. After this is done, the receiving members 104 may be removed from the coin tray 118. The advantages of the present invention include the following: it provides a simple sorting device with few moving part, it does not jam or back-fill, and it provides a quick and easy means for packaging coins.

In the implementations illustrated above, the coin tray 118 is configured to support four tubular coin receiving members 104, corresponding to the denominations of dimes, pennies, nickels, and quarters, respectively. However, in other implementations, the coin tray 118 may be configured to support addition coin receiving members 104 corresponding to, for example, silver dollars and/or fifty-cent pieces.

In general, terms such as "coupled to," and "configured for coupling to" and "secured to" (for example, a first component is "coupled to" or "is configured for coupling to" or is "secured to" a second component), or "communicate" (for example, a first component "communicates with" or "is in communication with" a second component) are used herein to indicate a structural, functional, mechanical, electrical, signal, optical, magnetic, electromagnetic, ionic or fluidic relationship between two or more components (or elements, features, or the like). As such, the fact that one component is said to couple to a second component is not intended to exclude the possibility that additional components may be present between, and/or operatively associated or engaged with, the first and second components.

Although the previous description only illustrates particular examples of various implementations, the invention is not limited to the foregoing illustrative examples. A person skilled in the art is aware that various aspects or details of the invention may be changed without departing from the scope of the invention and, further, the invention as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An automatic coin sorting device comprising:

a housing including a hopper configured for receiving coins;

a coin tray coupled to the housing, wherein the coin tray pivots inward and outward from the point of attachment to the housing; and a plurality of tubular coin receiving members removably secured to the coin tray, wherein each tubular coin receiving member is configured for receiving a different-sized coin, whereby each tubular coin receiving member includes an opening having a face for receiving coins comprising a substantially horizontal portion at the back of the top opening of each member that transitions into an angled portion that slants downward from the top of the tubular coin receiving member, where the angled opening enables excess coins to fall from the top of the receiving member when the receiving member accumulates a pre-determined number of coins and where the substantially horizontal portion facilitates the falling of the coins into the tubular coin receiving members by reducing the open space between the coin receiving members and the apertures in communication with the receiving members, while still allowing the coins to exit forward upon overflow.

2. The coin sorting device of claim 1 further comprising a coin separating wheel in communication with the hopper and configured for separating different-sized coins, wherein the coin separating wheel is positioned within the housing.

3. The coin sorting device of claim 2 further comprising a ramp in communication with the coin separating wheel, wherein the ramp is configured for receiving the separated coins from the coin separating wheel and providing a pathway for the coins to be distributed to the coin receiving members via apertures in communication with the coin receiving members, wherein each aperture is sized to distribute a different-sized coin.

4. An automatic coin sorting device comprising:

a housing including:

a front panel;

a back panel secured to the front panel;

a top portion including a hopper configured for receiving coins; and a bottom portion including a compartment configured for receiving a coin tray hingedly affixed to a side wall of the compartment, wherein the coin tray is alterable between a closed position and an open position, wherein in the closed position, the coin tray is positioned within the compartment, and in the open position, the coin tray is positioned at an angle θ relative to the front panel, wherein θ ranges from 0° to 90°;

a plurality of tubular coin receiving members removably secured to the coin tray, wherein each tubular coin receiving member is configured for receiving a different-sized coin, whereby each tubular coin receiving member includes a top opening having a face for receiving coins comprising having a substantially horizontal portion at the back of the top opening of each member that transitions into an angled portion, that slants downward from the top of the tubular coin receiving member, where the angled opening enables excess coins to fall from the top of the receiving member when the receiving member accumulates a pre-determined number of coins and where the substantially horizontal portion facilitates the falling of the coins into the tubular coin receiving members by reducing the open space between the coin receiving members and the apertures in communication with the receiving members, while still allowing the coins to exit forward upon overflow;

a coin separating wheel in communication with the hopper and configured for separating different-sized coins, wherein the coin separating wheel is positioned between the front panel and the back panel;

a ramp in communication with the coin separating wheel, wherein the ramp is configured for receiving the separated coins from the coin separating wheel and providing a pathway for the coins to be distributed to the coin receiving members via apertures in communication with the coin receiving members, wherein each aperture is sized to distribute a different-sized coin.

5. The coin sorting device of claim 4, where the predetermined number of coins is 50 pennies.

6. The coin sorting device of claim 4, where the predetermined number of coins is 40 nickels.

7. The coin sorting device of claim 4, where the predetermined number of coins is 50 dimes.

8. The coin sorting device of claim 4, where the predetermined number of coins is 40 quarters.

9. A tubular coin receiving member for removably securing to a coin tray of a coin sorting device, the claimed coin sorting device having at least one aperture, the tubular coin receiving member configured for receiving a predetermined sized coin, said tubular coin receiving member further including a top opening, the top opening having a face for receiving coins comprising a substantially horizontal portion at the back of the top opening of each member that transitions into an angled portion that slants downward from the top of the tubular coin receiving member where the angled opening enables excess coins to fall from the top of the receiving member when the coin receiving member accumulates a pre-determined number of coins and where the substantially horizontal portion facilitates the falling of the coins into the tubular coin receiving member by reducing the open space between the coin receiving member and the aperture in communication with the receiving member, while still allowing the coins to exit forward upon overflow.

10. The tubular coin receiving member of claim 9, where the angled opening enables excess coins to fall from the top of the receiving member when the receiving member accumulates a pre-determined number of coins.

11. The tubular coin receiving member of claim 10, where the predetermined number of coins is 50 pennies.

12. The tubular coin receiving member of claim 10, where the predetermined number of coins is 40 nickels.

13. The tubular coin receiving member of claim 10, where the predetermined number of coins is 50 dimes.

14. The tubular coin receiving member of claim 10, where the predetermined number of coins is 40 quarters.

* * * * *